US011188004B2

(12) United States Patent
Noguchi et al.

(10) Patent No.: US 11,188,004 B2
(45) Date of Patent: Nov. 30, 2021

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Daisuke Noguchi, Kanagawa (JP); Yasuaki Hashimoto, Kanagawa (JP); Takashi Inukai, Kanagawa (JP); Takuro Watanabe, Kanagawa (JP); Sakiko Takeuchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/939,176

(22) Filed: Jul. 27, 2020

(65) Prior Publication Data

US 2021/0216025 A1 Jul. 15, 2021

(30) Foreign Application Priority Data

Jan. 15, 2020 (JP) ..... JP2020-004618

(51) Int. Cl.

| | |
|---|---|
| ***G03G 9/08*** | (2006.01) |
| ***G03G 21/00*** | (2006.01) |
| ***G03G 9/097*** | (2006.01) |
| ***G03G 15/14*** | (2006.01) |
| ***G03G 15/20*** | (2006.01) |
| ***G03G 15/00*** | (2006.01) |
| ***G03G 15/08*** | (2006.01) |
| ***G03G 9/113*** | (2006.01) |

(52) U.S. Cl.

CPC ..... *G03G 9/0825* (2013.01); *G03G 9/0819* (2013.01); *G03G 9/0821* (2013.01); *G03G 9/09708* (2013.01); *G03G 9/1138* (2013.01); *G03G 9/1139* (2013.01); *G03G 15/0865* (2013.01); *G03G 15/14* (2013.01); *G03G 15/20* (2013.01); *G03G 15/605* (2013.01); *G03G 21/0011* (2013.01)

(58) Field of Classification Search

CPC ..... G03G 9/09708; G03G 9/1138; G03G 9/1139; G03G 9/0819; G03G 9/0821

USPC ..... 430/108.1

See application file for complete search history.

(56) References Cited

U.S. PATENT DOCUMENTS 5,733,702 A * 3/1998 Okado ..... G03G 9/097 430/108.6

FOREIGN PATENT DOCUMENTS

| | | |
|---|---|---|
| JP | 2006-317489 A | 11/2006 |
| JP | 2008-015334 A | 1/2008 |
| JP | 2008-224881 A | 9/2008 |
| JP | 2009-237274 A | 10/2009 |
| JP | 2011-028163 A | 2/2011 |

* cited by examiner

*Primary Examiner* — Mark A Chapman

(74) *Attorney, Agent, or Firm* — Sughrue Mion, PLLC

(57) ABSTRACT

An electrostatic image developing toner includes toner particles, layered compound particles, and inorganic particles. The content of titanium in the electrostatic image developing toner is 0.1 ppm or more and less than 1,500 ppm.

20 Claims, 2 Drawing Sheets

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-004618 filed Jan. 15, 2020.

BACKGROUND

(i) Technical Field

The present disclosure relates to an electrostatic image developing toner, an electrostatic image developer, a toner cartridge, a process cartridge, an image forming apparatus, and an image forming method.

(ii) Related Art

Japanese Laid Open Patent Application Publication No. 2006-317489 discloses a toner that includes toner base particles having an average circularity of 0.94 to 0.995 and a volume average particle size of 3 to 9 μm and melamine cyanurate powder particles having a volume average particle size of 3 to 9 μm which are deposited on the toner base particles such that the amount of the melamine cyanurate powder particles is 0.1 to 2.0 parts by weight relative to 100 parts by weight of the toner base particles.

Japanese Laid Open Patent Application Publication No. 2009-237274 discloses a positively chargeable toner that includes colored resin particles including a binder resin, a colorant, and a positively-charging control agent and melamine cyanurate particles having a number average primary particle size of 0.05 to 1.5 μm which are deposited on the colored resin particles such that the amount of the melamine cyanurate particles is 0.01 to 0.5 parts by weight relative to 100 parts by weight of the colored resin particles.

Japanese Laid Open Patent Application Publication No. 2008-015334 discloses an electrostatic image developing toner in which the aluminum content measured by an X-ray fluorescence analysis is 0.005% to 0.040% by mass and the titanium content measured by inductively coupled plasma (ICP) emission spectrometry is 50 to 500 ppm.

Japanese Laid Open Patent Application Publication No. 2008-224881 discloses an aggregation toner that includes silica particles having a number average primary particle size of 80 to 300 nm and titanium oxide particles having a number average primary particle size of 10 to 100 nm and has a silicon (Si)/titanium (Ti) intensity ratio of 4.5 to 22.0.

Japanese Laid Open Patent Application Publication No. 2011-028163 discloses a toner that includes toner particles containing 30 ppm or more and 1,000 ppm or less of Ti and alumina particles having a volume basis median diameter of 0.40 μm or more and 0.90 μm or less and an average circularity of 0.940 or more and 0.970 or less and containing 100 ppm or more and 500 ppm or less of Si.

SUMMARY

Aspects of non-limiting embodiments of the present disclosure relate to an electrostatic image developing toner capable of reducing the formation of a coating film on the surface of an image holding member and wearing of a cleaning blade, which cleans the image holding member, compared with electrostatic image developing toners including toner particles, layered compound particles, and inorganic particles, wherein the Ti content is less than 0.1 ppm or is 1,500 ppm or more.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developing toner including toner particles, layered compound particles, and inorganic particles. A content of titanium in the electrostatic image developing toner is 0.1 ppm or more and less than 1,500 ppm.

BRIEF DESCRIPTION OF THE DRAWINGS

Exemplary embodiments of the present disclosure will be described in detail based on the following figures, wherein.

DETAILED DESCRIPTION

Figure 1:
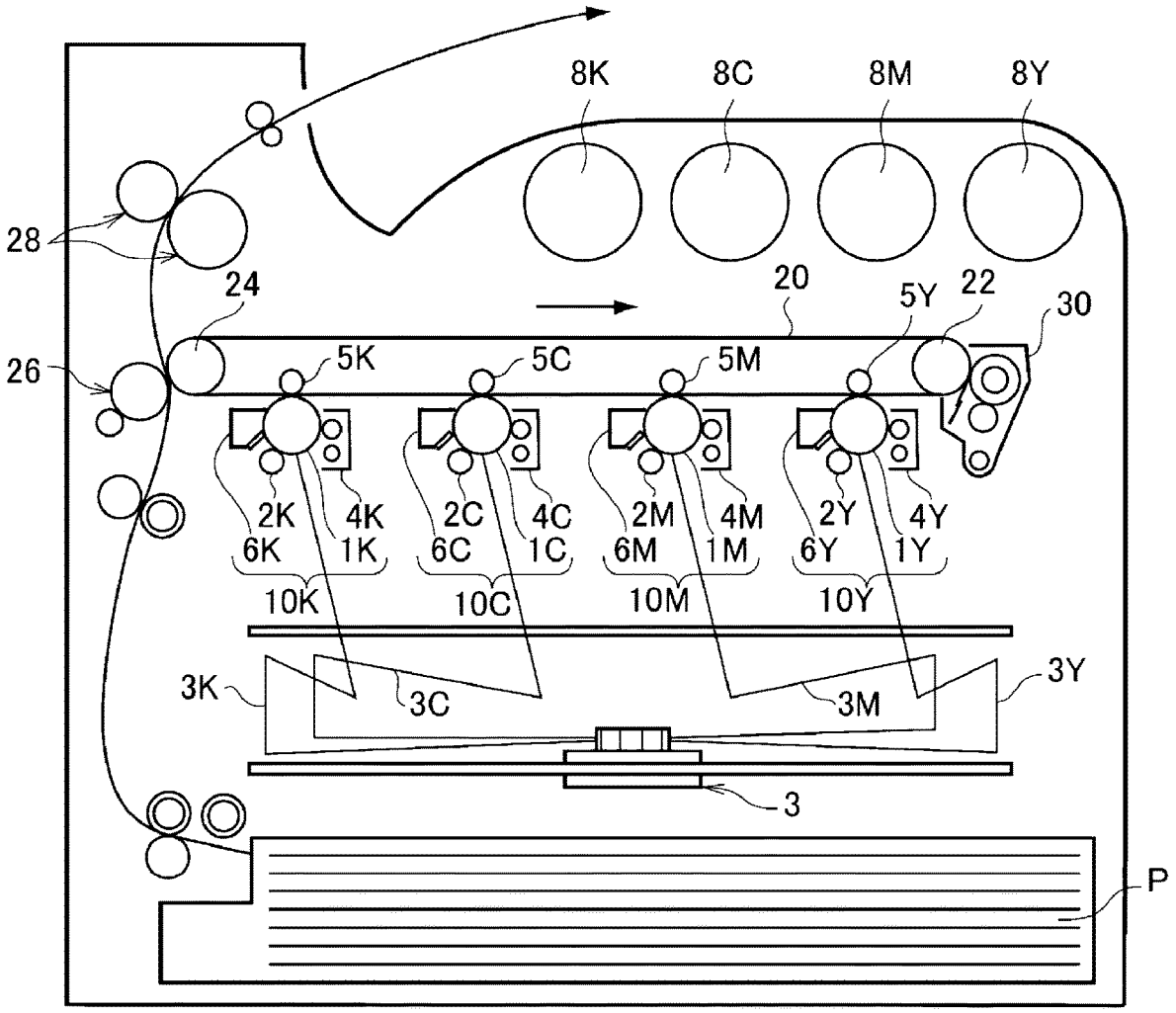
FIG. 1 is a schematic diagram illustrating an example of an image forming apparatus according to an exemplary embodiment.

An exemplary embodiment of the present disclosure is described below. The following description and Examples below are intended to be illustrative of the exemplary embodiment and not restrictive of the scope of the exemplary embodiment.

In the present disclosure, a numerical range expressed using "to" means the range specified by the minimum and maximum described before and after "to", respectively.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

In the present disclosure, the number of types of particles that correspond to a component may be two or more. In the case where a composition includes plural types of particles that correspond to a component of the composition, the particle size of the component is the particle size of a mixture of the plural types of particles included in the composition unless otherwise specified.

In the present disclosure, an electrostatic image developing toner may be referred to simply as "toner", and an electrostatic image developer may be referred to simply as "developer".

Electrostatic Image Developing Toner

A toner according to the exemplary embodiment includes toner particles, layered compound particles, and inorganic particles. The Ti content in the entire toner is 0.1 ppm or more and less than 1,500 ppm. Note that "ppm" is the abbreviation for parts per million and on a mass basis.

The Ti content in the toner may be determined by an X-ray fluorescence analysis. Specifically, the measurement is conducted in the following manner.

Polyester resin particles and titanium oxide particles are mixed with each other at predetermined proportions to form a mixture. About 200 mg of the mixture is formed into a pellet having a diameter of 13 mm with an IR tablet molding machine. Hereby, a pellet sample is prepared. The mass of the pellet sample is precisely weighed. The pellet sample is subjected to an X-ray fluorescence analysis to determine a peak intensity for titanium. The above measurement is conducted using plural samples prepared by changing the mixing ratio of titanium oxide. A calibration curve that represents the relationship between the titanium content and the titanium peak intensity is prepared on the basis of the results obtained by measuring the plural samples.

About 200 mg of the toner is subjected to the X-ray fluorescence analysis of a pellet sample as described above to determine the titanium peak intensity. The Ti content in the toner is determined on the basis of the calibration curve.

The toner according to the exemplary embodiment may reduce the formation of a coating film on the surface of an image holding member and wearing of the cleaning blade of the image holding member. The mechanisms for this are presumably as described below.

Toners that include layered compound particles, such as melamine cyanurate particles and boron nitride particles, used as an external additive are known. The layered compound particles are particles of a compound having a layered structure with an interlayer distance of the order of angstroms and are considered to produce a lubricating effect as a result of the layers becoming displaced with respect to one another. The layered compound particles deposited on the toner particles as an external additive serve as a lubricant at the point at which an image holding member and the cleaning blade contact with each other.

However, in the case where the toner included in a developing device is replaced at short intervals during image formation, such as in the case where a high-density image is formed continuously for a long period of time, the amount of the layered compound particles separated from the toner particles is relatively large. The excessive amount of the separated layered compound particles may slip through the cleaning blade of the image holding member and form a coating film on the surface of the image holding member. This phenomenon is referred to as "filming". Filming may occur significantly when an image is formed in a low temperature, low humidity environment (e.g., at 10° C. and a relative humidity of 15%), where the likelihood of the layered compound particles becoming separated from the toner particles is high.

In contrast, in the case where the toner includes titanium, titanium particles interposed between the surfaces of the toner particles and the layered compound particles may attract the layered compound particles and reduce the amount of the layered compound particles separated from the toner particles. In order to achieve the above action, the Ti content in the toner according to the exemplary embodiment is 0.1 ppm or more, is preferably 0.2 ppm or more, and is more preferably 0.3 ppm or more.

However, if the content of titanium in the toner is excessively high, the likelihood of the layered compound particles becoming separated from the toner particles may be reduced. In such a case, when the toner included in a developing device is replaced at long intervals during image formation, such as in the case where a low-density image is formed continuously for a long period of time, the layered compound particles strongly adhere to the toner particles as a result of the stirring performed in the developing device and the amount of the layered compound particles separated from the toner particles is small. Accordingly, the amount of the layered compound particles supplied to the cleaning blade of the image holding member is reduced. This increases the occurrence of wearing of the cleaning blade of the image holding member. The above phenomenon may occur significantly when an image is formed in a high temperature, high humidity environment (e.g., at 32° C. and a relative humidity of 85%), where the likelihood of the layered compound particles becoming separated from the toner particles is low. In order to reduce the wearing of the cleaning blade of the image holding member, the Ti content in the toner according to the exemplary embodiment is less than 1,500 ppm, is preferably 1,000 ppm or less, and is more preferably 500 ppm or less.

Examples of the titanium source included in the toner include titanium oxide ($TiO_2$). Titanium oxide may be used as either an external or internal additive.

Details of the components, structure, and properties of the toner according to the exemplary embodiment are described below.

Toner Particles

The toner particles include, for example, a binder resin and may optionally include a colorant, a release agent, and other additives.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

The binder resin may be a polyester resin.

Examples of the polyester resin include amorphous polyester resins known in the related art. A crystalline polyester resin may be used as a polyester resin in combination with an amorphous polyester resin. In such a case, the content of the crystalline polyester resin in the binder resin may be 2% by mass or more and 40% by mass or less and is preferably 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adduct and bisphenol A-propylene oxide adduct. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121: 1987 "Testing Methods for Transition Temperatures of Plastics".

The weight average molecular weight Mw of the amorphous polyester resin is preferably 5,000 or more and 1,000,000 or less and is more preferably 7,000 or more and 500,000 or less.

The number average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight average molecular weight and number average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average molecular weight and number average molecular weight of the amorphous polyester resin are determined on the basis of the results of the measurement using a molecular-weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers used in the copolymerization reaction have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from polymerizable monomers having an aromatic ring.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The crystalline polyester resin may have a weight average molecular weight Mw of 6,000 or more and 35,000 or less.

The crystalline polyester resin may be produced by any suitable method known in the related art similarly to, for example, the amorphous polyester resin.

The content of the binder resin in the toner particles is preferably 40% by mass or more and 95% by mass or less, is more preferably 50% by mass or more and 90% by mass or less, and is further preferably 60% by mass or more and 85% by mass or less.

Colorant

Examples of the colorant include pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The content of the release agent in the toner particles is preferably 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

In the case where the toner according to the exemplary embodiment includes titanium oxide ($TiO_2$) as an internal additive, the number average primary particle size of the titanium oxide particles is preferably 5 nm or more and 100 nm or less, is more preferably 7 nm or more and 70 nm or less, and is further preferably 10 nm or more and 50 nm or less.

Properties, etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume average diameter D50v of the toner particles is preferably 2 μm or more and 10 μm or less and is more preferably 4 μm or more and 8 μm or less.

The volume average diameter (D50v) of the toner particles is measured using "COULTER MULTISIZER II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000. A volume particle size distribution is drawn in ascending order in terms of particle diameter. The particle diameter at which the cumulative volume reaches 50% is considered the volume average particle diameter D50v.

The toner particles preferably has an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3,500.

In the case where the toner includes an external additive, the toner (i.e., the developer) to be measured is dispersed in water containing a surfactant and then subjected to an ultrasonic wave treatment in order to remove the external additive from the toner particles.

Layered Compound Particles

The layered compound particles are particles of a compound having a layered structure. Examples of the layered compound particles include melamine cyanurate particles, boron nitride particles, graphite fluoride particles, molybdenum disulfide particles, and mica particles.

The volume average particle size of the layered compound particles is preferably 0.4 μm or more and less than 8.0 μm, is more preferably 0.7 μm or more and 7.5 μm or less, and is further preferably 1.0 μm or more and 7.0 μm or less in order to reduce the aggregation of the layered compound particles. The volume average particle size of the layered compound particles may be controlled by disintegration, classification, or a combination of disintegration and classification.

The volume average particle size of the layered compound particles is determined by the following measuring method.

First, the layered compound particles are separated from the toner. The method for separating the layered compound particles from the toner is not limited. For example, an ultrasonic wave is applied to a dispersion liquid prepared by dispersing the toner particles in water containing a surfactant. The dispersion liquid is subjected to high-speed centrifugation to separate the toner particles, the layered compound particles, and the other external additive particles from one another by centrifugal force on the basis of specific gravity. The fraction containing the layered compound particles is extracted and dried to obtain layered compound particles.

The layered compound particles are added to an aqueous electrolyte solution (aqueous ISOTON solution). An ultrasonic wave is applied to the resulting mixture for 30 seconds or more in order to form a dispersion liquid. This dispersion liquid is used as a sample. The particle size of the layered compound particles is measured with a laser diffraction/scattering particle size distribution analyzer, such as "MICROTRAC MT3000II" produced by MicrotracBEL Corp. At least 3,000 layered compound particles are measured. The particle size at which the cumulative volume reaches 50% in a volume particle size distribution drawn in ascending order in terms of particle size is considered the volume average particle size.

The content of the layered compound particles in the toner is preferably 0.01% by mass or more, is more preferably 0.05% by mass or more, and is further preferably 0.1% by mass or more of the total amount of the toner in order to produce the lubricating effect of the layered compound particles. The content of the layered compound particles in the toner is preferably 1.0% by mass or less, is more preferably 0.7% by mass or less, and is further preferably 0.5% by mass or less of the total amount of the toner in order to reduce the aggregation of the layered compound particles.

Inorganic Particles

Examples of the inorganic particles included in the toner according to the exemplary embodiment as an external additive include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO.SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles.

The surfaces of the inorganic particles may be subjected to a hydrophobic treatment. The hydrophobic treatment is performed by, for example, immersing the inorganic particles in a hydrophobizing agent. Examples of the hydrophobizing agent include, but are not limited to, a silane coupling agent, a silicone oil, a titanate coupling agent, and aluminum coupling agent. These hydrophobizing agents may be used alone or in combination of two or more. The amount of the hydrophobizing agent is commonly, for example, 1 part by mass or more and 10 parts by mass or less relative to 100 parts by mass of the inorganic particles.

The number average particle size of the inorganic particles is preferably 0.01 μm or more and 0.4 μm or less, is more preferably 0.02 μm or more and 0.3 μm or less, and is further preferably 0.03 μm or more and 0.2 μm or less.

The number average particle size of the inorganic particles is determined by the following measuring method.

First, the inorganic particles are separated from the toner. The method for separating the inorganic particles from the toner is not limited. For example, an ultrasonic wave is applied to a dispersion liquid prepared by dispersing the toner particles in water containing a surfactant. The dispersion liquid is subjected to high-speed centrifugation to separate the toner particles, the layered compound particles, and the inorganic particles from one another by centrifugal force on the basis of specific gravity. The fraction containing the inorganic particles is extracted and dried to obtain inorganic particles.

Images of the above inorganic particles are taken with a scanning electron microscope (SEM). The images are analyzed to calculate the equivalent circle diameter (μm or nm) of each of randomly selected 1,000 primary particles. The equivalent circle diameter at which the cumulative number reaches 50% in a number equivalent circle diameter distribution drawn in ascending order in terms of equivalent circle diameter is considered the number average particle size.

In the case where the toner according to the exemplary embodiment includes titanium oxide ($TiO_2$) as an external additive, the number average primary particle size of the titanium oxide particles is preferably 5 nm or more and 100 nm or less, is more preferably 7 nm or more and 70 nm or less, and is further preferably 10 nm or more and 50 nm or less.

In the case where the toner according to the exemplary embodiment includes titanium oxide particles as an external additive, the mass ratio Mb/Ma of the content Mb of the titanium oxide particles to the content Ma of the layered compound particles is preferably 0.0002 or more and 1.55 or less, is more preferably 0.01 or more and 1.3 or less, and is further preferably 0.05 or more and 1.0 or less.

In the case where the toner according to the exemplary embodiment includes silica ($SiO_2$) as an external additive, the content of silica in the entire toner is preferably 0.01% by mass or more and 10% by mass or less, is more preferably 0.05% by mass or more and 5% by mass or less, and is further preferably 0.1% by mass or more and 3% by mass or less.

Other External Additive

The toner according to the exemplary embodiment may optionally include an external additive other than the layered compound particles or the inorganic particles. Examples of the other external additive include particles of a resin, such as polystyrene, polymethyl methacrylate, or a melamine resin; and particles of a cleaning lubricant, such as a metal salt of a higher fatty acid, such as zinc stearate, or a fluorine-contained resin.

In the case where the toner according to the exemplary embodiment includes an external additive other than the layered compound particles or the inorganic particles, the total amount of the other external additives used is preferably 0.01% by mass or more and 5.0% by mass or less and is more preferably 0.01% by mass or more and 2.0% by mass or less of the amount of the toner particles.

Method for Producing Toner

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle formation step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail.

Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release agent particle dispersion liquid in which release agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media.

Examples of the aqueous media include water, such as distilled water and ion-exchange water; and alcohols. These aqueous media may be used alone or in combination of two or more.

Examples of the surfactant include anionic surfactants, such as sulfate surfactants, sulfonate surfactants, and phosphate surfactants; cationic surfactants, such as amine salt surfactants and quaternary ammonium salt surfactants; and nonionic surfactants, such as polyethylene glycol surfactants, alkylphenol ethylene oxide adduct surfactants, and polyhydric alcohol surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion liquid, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the dispersion medium by, for example, phase-inversion emulsification. Phase-inversion emulsification is a method in which the resin to be dispersed is dissolved in a hydrophobic organic solvent in which the resin is soluble, a base is added to the resulting organic continuous phase (i.e., O phase) to perform neutralization, and subsequently an aqueous medium (i.e., W phase) is charged in order to perform phase inversion from W/O to O/W and disperse the resin in the aqueous medium in the form of particles.

The volume average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume average diameter of the resin particles is determined in the following manner. The particle diameter distribution of the resin particles is obtained using a laser-diffraction particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release agent particle dispersion liquid, and the like are also prepared as in the preparation of the resin particle dispersion liquid. In other words, the above-described specifications for the volume average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release agent particles dispersed in the release agent particle dispersion liquid.

Aggregated Particle Formation Step

The resin particle dispersion liquid is mixed with the colorant particle dispersion liquid and the release agent particle dispersion liquid.

In the resulting mixed dispersion liquid, heteroaggregation of the resin particles with the colorant particles and the release agent particles is performed in order to form aggregated particles including the resin particles, the colorant particles, and the release agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles−30° C.] or more and [the glass transition temperature−10° C.] or less), and thereby the particles dispersed in the mixed dispersion liquid are caused to aggregate together to form aggregated particles.

In the aggregated particle formation step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Hereby, toner particles are prepared.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the resin particles are deposited on the surfaces of the aggregated particles in order to form second aggregated particles; and by heating the resulting second-aggregated particle dispersion liquid in which the second aggregated particles are dispersed and thereby causing fusion and coalescence of the second aggregated particles to occur in order to form toner particles having a core-shell structure. Titanium oxide may be added to the insides of the toner particles by using a liquid mixture prepared by mixing titanium oxide with the resin particle dispersion liquid used in the step of forming the second aggregated particles.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Electrostatic Image Developer

An electrostatic image developer according to the exemplary embodiment includes at least the toner according to the exemplary embodiment.

The electrostatic image developer according to the exemplary embodiment may be a single component developer including only the toner according to the exemplary embodiment or may be a two-component developer that is a mixture of the toner and a carrier.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin-impregnated carrier prepared by impregnating a porous magnetic powder with a resin. The magnetic-powder-dispersed carrier and the resin-impregnated carrier may also be prepared by coating the surfaces of particles constituting the carrier, that is, core particles, with a resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles. Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a resin by, for example, using a coating-layer forming solution prepared by dissolving the coat resin and, as needed, various types of additives in a suitable solvent. The type of the solvent is not limited and may be selected with consideration of the type of the resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Image Forming Apparatus and Image Forming Method

An image forming apparatus according to the exemplary embodiment includes an image holding member; a charging unit that charges the surface of the image holding member; an electrostatic image formation unit that forms an electrostatic image on the charged surface of the image holding member; a developing unit that includes an electrostatic image developer and develops the electrostatic image formed on the surface of the image holding member with the electrostatic image developer to form a toner image; a transfer unit that transfers the toner image formed on the surface of the image holding member onto the surface of a recording medium; a fixing unit that fixes the toner image onto the surface of the recording medium; and a cleaning unit that includes a blade arranged to contact with the surface of the image holding member and removes a toner that remains on the surface of the image holding member after transfer of the toner image with the blade. The electrostatic image developer is the electrostatic image developer according to the exemplary embodiment.

The image forming apparatus according to the exemplary embodiment uses an image forming method (image forming method according to the exemplary embodiment) including charging the surface of the image holding member; forming an electrostatic image on the charged surface of the image holding member; developing the electrostatic image formed on the surface of the image holding member with the electrostatic image developer according to the exemplary embodiment to form a toner image; transferring the toner image formed on the surface of the image holding member onto the surface of a recording medium; fixing the toner image onto the surface of the recording medium; and bringing a blade into contact with the surface of the image holding member after transfer of the toner image to remove a toner that remains on the surface of the image holding member.

The image forming apparatus according to the exemplary embodiment may be any image forming apparatus known in the related art, such as a direct-transfer image forming apparatus in which a toner image formed on the surface of an image holding member is directly transferred to a recording medium; an intermediate-transfer image forming apparatus in which a toner image formed on the surface of an image holding member is transferred onto the surface of an intermediate transfer body in the first transfer step and the toner image transferred on the surface of the intermediate transfer body is transferred onto the surface of a recording medium in the second transfer step; and an image forming apparatus including a static-erasing unit that erases static by irradiating the surface of an image holding member with static-erasing light subsequent to the transfer of the toner image before the image holding member is again charged.

In the case where the image forming apparatus according to the exemplary embodiment is the intermediate-transfer image forming apparatus, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including the electrostatic image developer according to the exemplary embodiment and the developing unit.

An example of the image forming apparatus according to the exemplary embodiment is described below, but the image forming apparatus is not limited thereto. Hereinafter, only components illustrated in drawings are described; others are omitted.

FIG. 1 schematically illustrates the image forming apparatus according to the exemplary embodiment.

The image forming apparatus illustrated in FIG. 1 includes first to fourth electrophotographic image formation units 10Y, 10M, 10C, and 10K that form yellow (Y), magenta (M), cyan (C), and black (K) images, respectively, on the basis of color separation image data. The image formation units (hereinafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24 and runs clockwise in FIG. 1, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to contact with the image-carrier-side surface of the intermediate transfer belt 20 and to face the drive roller 22.

Developing devices (examples of the developing units) 4Y, 4M, 4C, and 4K of the units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive member cleaning device (example of the cleaning unit) 6Y that removes a toner remaining on the surface of the photosensitive member 1Y after the first transfer.

The photosensitive member cleaning device 6Y includes a cleaning blade arranged to contact with the surface of the photosensitive member 1Y. The cleaning blade is arranged to contact with the surface of the photosensitive member 1Y that keeps rotating after the transfer of the toner image and removes the toner particles remaining on the surface of the photosensitive member 1Y.

The first transfer roller 5Y is disposed so as to contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the erased latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

After the transfer of the toner image, the photosensitive member 1Y keeps rotating and contacts with the cleaning blade included in the photosensitive member cleaning device 6Y. The toner particles remaining on the photosensitive member 1Y are removed by the photosensitive member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple-transferred in the first to fourth units is then transported to a second transfer section including a support roller 24 contacting with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

Subsequently, the recording paper P is transported into a nip part of the fixing device (example of the fixing unit) 28 at which a pair of fixing rollers contact with each other. The toner image is fixed to the recording paper P to form a fixed image.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Process Cartridge and Toner Cartridge

A process cartridge according to the exemplary embodiment includes an image holding member, a developing unit that includes the electrostatic image developer according to the exemplary embodiment and develops an electrostatic image formed on the surface of an image holding member with the electrostatic image developer to form a toner image, and a cleaning unit that includes a blade arranged to contact with the surface of the image holding member and removes a toner that remains on the surface of the image holding member after transfer of the toner image with the blade. The process cartridge according to the exemplary embodiment is detachably attachable to an image forming apparatus.

The structure of the process cartridge according to the exemplary embodiment is not limited to the above-described one. The process cartridge according to the exemplary embodiment may further include, in addition to the developing unit, at least one unit selected from a charging unit, an electrostatic image formation unit, a transfer unit, etc.

An example of the process cartridge according to the exemplary embodiment is described below, but the process cartridge is not limited thereto. Hereinafter, only components illustrated in FIG. 2 are described; others are omitted.

Figure 2:
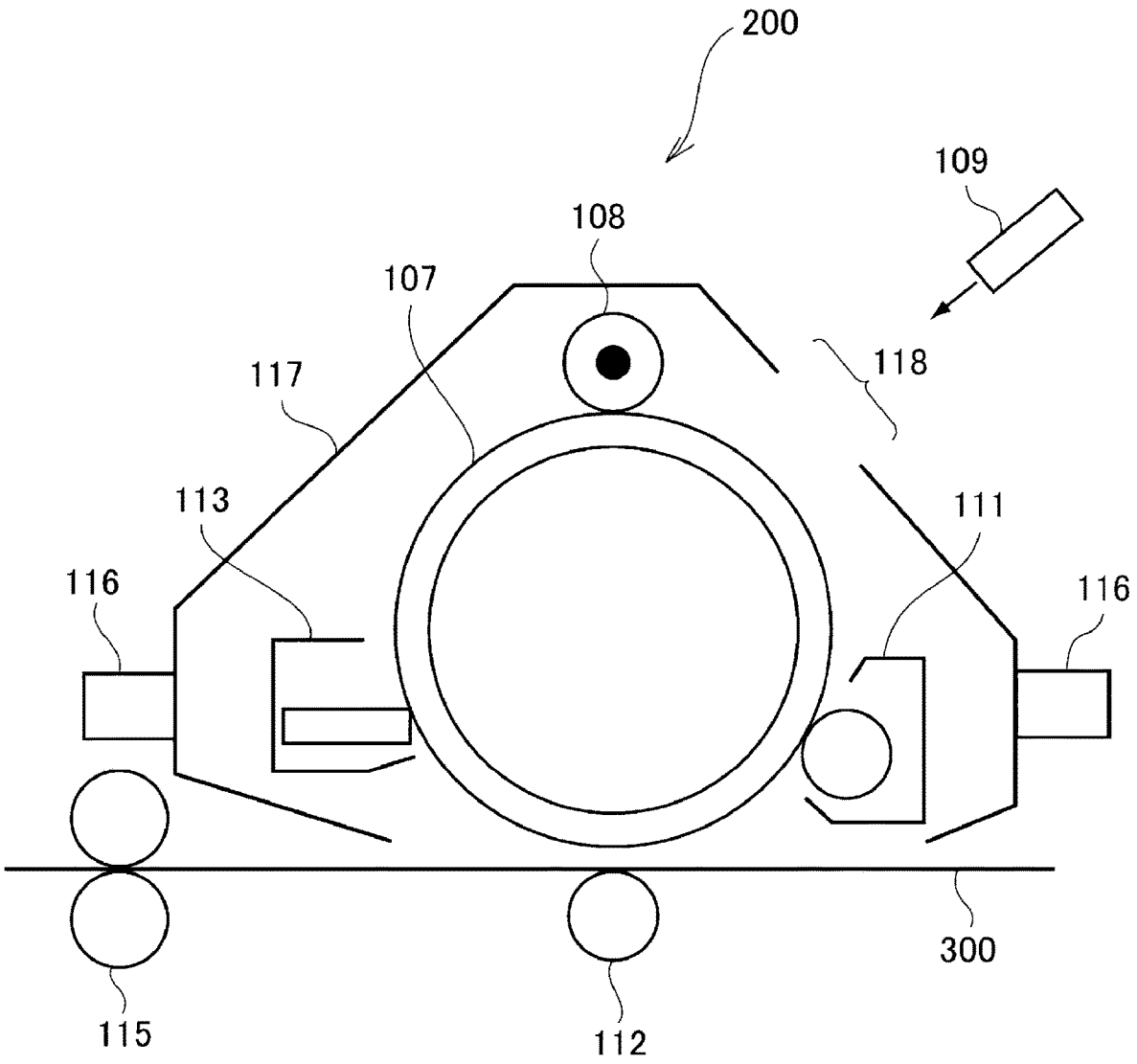
FIG. 2 is a schematic diagram illustrating an example of a process cartridge according to an exemplary embodiment which is detachably attachable to an image forming apparatus.

FIG. 2 schematically illustrates the process cartridge according to the exemplary embodiment.

A process cartridge 200 illustrated in FIG. 2 includes, for example, a photosensitive member 107 (example of the image holding member), a charging roller 108 (example of the charging unit) disposed on the periphery of the photosensitive member 107, a developing device 111 (example of the developing unit), and a photosensitive member cleaning device 113 (example of the cleaning unit), which are combined into one unit using a housing 117 to form a cartridge. The housing 117 has an aperture 118 for exposure. A mounting rail 116 is disposed on the housing 117. The photosensitive member cleaning device 113 includes a blade arranged to contact with the photosensitive member 107.

In FIG. 2, Reference numeral 109 denotes an exposure device (example of the electrostatic image formation unit), Reference numeral 112 denotes a transfer device (example of the transfer unit), Reference numeral 115 denotes a fixing device (example of the fixing unit), and the Reference numeral 300 denotes recording paper (example of the recording medium).

A toner cartridge according to the exemplary embodiment includes the toner according to the exemplary embodiment and is detachably attachable to an image forming apparatus. The toner cartridge includes a replenishment toner that is to be supplied to the developing unit disposed inside an image forming apparatus.

The image forming apparatus illustrated in FIG. 1 is an image forming apparatus that includes the toner cartridges 8Y, 8M, 8C, and 8K detachably attached to the image forming apparatus. Each of the developing devices 4Y, 4M, 4C, and 4K is connected to a specific one of the toner cartridges which corresponds to the developing device (color) with a toner supply pipe (not illustrated). When the amount of toner contained in a toner cartridge is small, the toner cartridge is replaced.

EXAMPLES

Details of the exemplary embodiment of the present disclosure are described below with reference to Examples below. The exemplary embodiment of the present disclosure is not limited to Examples below. Hereinafter, the terms "part" and "%" are on a mass basis unless otherwise specified.

Preparation of Toner Particles

Preparation of Amorphous Polyester Resin Dispersion Liquid (A1)

Ethylene glycol: 37 parts

Neopentyl glycol: 65 parts 1,9-Nonanediol: 32 parts

Terephthalic acid: 96 parts

The above materials are charged into a flask and heated to 200° C. over 1 hour. After it has been confirmed that the inside of the reaction system has been uniformly stirred, 1.2 parts of dibutyltin oxide is charged into the flask. While the product water is removed by distillation, the temperature is increased to 240° C. over 6 hours and stirring is continued for 4 hours at 240° C. Hereby, an amorphous polyester resin having an acid value of 9.4 mgKOH/g, a weight average molecular weight of 13,000, and a glass transition temperature of 62° C. is prepared. While the amorphous polyester resin is in a molten state, the amorphous polyester resin is transferred to an emulsification disperser "CAVITRON CD1010" produced by EUROTEC at a rate of 100 g/min. A 0.37%-dilute ammonia water prepared separately by diluting reagent ammonia water with ion-exchange water is charged into a tank and transferred to the emulsification disperser at a rate of 0.1 L/min as well as the amorphous polyester resin while being heated to 120° C. with a heat exchanger. The emulsification disperser is operated with a rotor rotation speed of 60 Hz and a pressure of 5 kg/cm$^2$. Hereby, an amorphous polyester resin dispersion liquid (A1) having a volume average particle size of 160 nm and a solid content of 20% is prepared.

Preparation of Crystalline Polyester Resin Dispersion Liquid (C1)

Decanedioic acid: 81 parts

Hexanediol: 47 parts

The above materials are charged into a flask and heated to 160° C. over 1 hour. After it has been confirmed that the inside of the reaction system has been uniformly stirred, 0.03 parts of dibutyltin oxide is charged into the flask. While the product water is removed by distillation, the temperature is increased to 200° C. over 6 hours and stirring is continued for 4 hours at 200° C. The reaction solution is cooled and solid-liquid separation is subsequently performed. The resulting solid substance is dried at 40° C. at reduced pressure. Hereby, a crystalline polyester resin (C1) having a melting point of 64° C. and a weight average molecular weight of 15,000 is prepared.

Crystalline polyester resin (C1): 50 parts

Anionic surfactant "NEOGEN RK" produced by Dai-ichi Kogyo Seiyaku Co., Ltd.: 2 parts Ion-exchange water: 200 parts The above materials are heated to 120° C. and sufficiently dispersed with a homogenizer "ULTRA-TURRAX T50" produced by IKA. A further dispersion treatment is performed with a pressure-discharge homogenizer. The resulting dispersion liquid is recovered when the volume average particle size thereof reaches 180 nm. Hereby, a crystalline polyester resin dispersion liquid (C1) having a solid content of 20% is prepared.

Preparation of Release Agent Particle Dispersion Liquid (W1)

Paraffin wax "HNP-9" produced by Nippon Seiro Co., Ltd.: 100 parts

Anionic surfactant "NEOGEN RK" produced by Dai-ichi Kogyo Seiyaku Co., Ltd.: 1 part Ion-exchange water: 350 parts The above materials are mixed with one another and heated to 100° C. The resulting mixture is dispersed with a homogenizer "ULTRA-TURRAX T50" produced by IKA and then further dispersed with a pressure-discharge Gaulin homogenizer. Hereby, a release agent particle dispersion liquid in which release agent particles having a volume average particle size of 200 nm are dispersed is prepared. Ion-exchange water is added to the release agent particle dispersion liquid in order to adjust the solid content in the dispersion liquid to be 20%. Hereby, a release agent particle dispersion liquid (W1) is prepared. Preparation of Colorant Particle Dispersion Liquid (K1)

Carbon black "REGAL330" produced by Cabot Corporation: 50 parts

Anionic surfactant "NEOGEN RK" produced by DKS Co. Ltd.: 5 parts

Ion-exchange water: 195 parts

The above materials are mixed with one another, and the resulting mixture is dispersed with ULTIMIZER produced by Sugino Machine Limited at 240 MPa for 10 minutes. Hereby, a colorant particle dispersion liquid (K1) having a solid content of 20% is prepared.

Preparation of Toner Particles (1)

Ion-exchange water: 200 parts

Amorphous polyester resin dispersion liquid (A1): 150 parts

Crystalline polyester resin dispersion liquid (C1): 10 parts

Release agent particle dispersion liquid (W1): 10 parts

Colorant particle dispersion liquid (K1): 15 parts

Anionic surfactant (TaycaPower): 2.8 parts

The above materials are charged into a round-bottom flask made of stainless steel. After the pH has been adjusted to be 3.5 by addition of 0.1 N nitric acid, an aqueous polyaluminum chloride solution prepared by dissolving 2 parts of polyaluminum chloride (30% powder produced by Oji Paper Co., Ltd.) in 30 parts of ion-exchange water is added to the flask. After dispersion has been performed with a homogenizer "ULTRA-TURRAX T50" produced by IKA at 30° C., the temperature is increased to 45° C. in a heating oil bath. Then, holding is performed until the volume average particle size reaches 5.2 μm.

Subsequently, 60 parts of the amorphous polyester resin dispersion liquid (A1) is added to the flask and holding is performed for 30 minutes. When the volume average particle size reaches 5.2 μm, another 60 parts of the amorphous polyester resin dispersion liquid (A1) is added to the flask and holding is performed for 30 minutes. Then, 20 parts of a 10% aqueous solution of nitrilotriacetic acid (NTA) metal salt "CHELEST 70" produced by Chelest Corporation is added to the flask. Subsequently, the pH is adjusted to be 9.0 by addition of a 1 N aqueous sodium hydroxide solution. Then, 1 part of an anionic surfactant "TaycaPower" is added to the flask. While stirring is continued, the temperature is increased to 85° C. and then holding is performed for 5 hours. Subsequently, the temperature is reduced to 20° C. at a rate of 20° C./min. Then, filtration is performed. The resulting substance is sufficiently washed with ion-exchange water and dried to form toner particles (1) having a volume average particle size of 5.9 μm.

Preparation of Toner Particles (2)

Toner particles (2) are prepared as in the preparation of the toner (1), except that a liquid mixture prepared by mixing a certain amount of hydrophobic titanium oxide particles "JMT2000" produced by TAYCA CORPORATION with 60 parts of the amorphous polyester resin dispersion liquid (A1) such that the content of the titanium oxide particles in the resulting toner is 0.05% by mass, instead of 60 parts of the amorphous polyester resin dispersion liquid (A1) used in the preparation of the toner (1).

Preparation of Layered Compound Particles

Preparation of Melamine Cyanurate Particles

Commercial melamine cyanurate "MC-4500" produced by Nissan Chemical Corporation is disintegrated and classified with a jet mill to prepare melamine cyanurate particles (1) to (5). Table 1 describes the volume average particle sizes of the melamine cyanurate particles (1) to (5). In Table 1, "MC" means melamine cyanurate.

Preparation of Boron Nitride Particles

Commercial boron nitride particles are disintegrated and classified with a jet mill. Table 1 describes the volume average particle size of the boron nitride particles. In Table 1, "BN" means boron nitride.

Preparation of Carrier

With 14 parts of toluene, 2 parts of a styrene-methyl methacrylate copolymer (polymerization mass ratio: 90:10, weight average molecular weight: 80,000) and 0.2 parts of carbon black "R330" produced by Cabot Corporation are mixed. The resulting mixture is stirred with a stirrer for 10 minutes to form a dispersion liquid. The dispersion liquid and 100 parts of ferrite particles having a volume average particle size of 36 μm are charged into a vacuum degassing kneader and then stirred at 60° C. for 30 minutes. While heating is performed, the pressure is reduced to perform degassing. Subsequently, drying is performed. Hereby, a carrier is prepared.

Example 1

Toner particles (1): 100 parts by mass

Hydrophobic silica particles "RY50" produced by Nippon Aerosil Co., Ltd.: 2.5 parts by mass Melamine cyanurate particles (1): 0.1 parts by mass Hydrophobic titanium oxide particles "JMT2000" produced by TAYCA CORPORATION: in a certain amount such that the content of the hydrophobic titanium oxide particles in the entire toner is 0.05% by mass The above materials are charged into a sample mill and stirred at 10,000 rpm for 30 seconds. Subsequently, screening is performed with a vibration sieve having an opening of 45 μm. Hereby, a toner having a volume average particle size of 5.9 μm is prepared. The toner and the carrier are charged into a V-blender at a mass ratio of Toner:Carrier=5:95. The resulting mixture is stirred for 20 minutes to form a developer.

Example 2

Toner particles (1): 100 parts by mass

Hydrophobic silica particles "RY50" produced by Nippon Aerosil Co., Ltd.: 2.5 parts by mass Melamine cyanurate particles (1): 0.1 parts by mass Mixture of 99.8 parts by mass of hydrophobic silica particles "RY50" produced by Nippon Aerosil Co., Ltd. with 0.2 parts by mass of hydrophobic titanium oxide particles "JMT2000" produced by TAYCA CORPORATION: in a certain amount such that the content of the hydrophobic titanium oxide particles in the entire toner is 0.00002% by mass The above materials are charged into a sample mill and stirred at 10,000 rpm for 30 seconds. Subsequently, screening is performed with a vibration sieve having an opening of 45 μm. Hereby, a toner having a volume average particle size of 5.9 μm is prepared. The toner and the carrier are charged into a V-blender at a mass ratio of Toner:Carrier=5:95. The resulting mixture is stirred for 20 minutes to form a developer.

Examples 3 to 12 and Comparative Examples 1 and 2

Toners and developers are prepared as in Example 1, except that the type or amount of the layered compound particles or the amount or size of the hydrophobic titanium oxide particles is changed as described in Table 1.

Performance Evaluations

Filming on Surface of Photosensitive Member

A specific one of the developers is charged into a developing device of a modification of an image forming apparatus "ApeosPort-IV C5575" produced by Fuji Xerox Co., Ltd. This image forming apparatus is left to stand for 1 day at 10° C. and a relative humidity of 15%. Then, an image having an area coverage of 50% is formed continuously on 15,000 A4 size paper sheets in the same environment as described above, that is, at 10° C. and a relative humidity of 15%. The surface of the photosensitive member and the last sheet are visually inspected and classified as follows. The grades "G1" to "G3" are considered acceptable.

G1: No filming occurs, and no white streaks are present in the image.

G2: Negligible filming occurs, but no white streaks are present in the image.

G3: Slight filming occurs, but no white streaks are present in the image.

G4: Filming occurs, and slight white streaks are present in the image.

G5: Filming occurs, and white streaks are present in the image.

Wearing of Cleaning Blade

A specific one of the developers is charged into a developing device of a modification of an image forming apparatus "ApeosPort-IV C5575" produced by Fuji Xerox Co., Ltd. This image forming apparatus is left to stand for 1 day at 32° C. and a relative humidity of 85%. Then, an image having an area coverage of 1% is formed continuously on 15,000 A4 size paper sheets in the same environment as described above, that is, at 32° C. and a relative humidity of 85%. The last sheet is visually inspected. The portion of the cleaning blade which contacts with the photosensitive member is observed with a microscope "VH6200" produced by Keyence Corporation at a 100-fold magnification. The number of the colored streaks formed in the image and the condition of the portion of the cleaning blade which contacts with the photosensitive member are classified as follows. The grades "G1" to "G3" are considered acceptable.

G1: The number of the colored streaks is 0, and chipping of the cleaning blade is not observed.

G2: The number of the colored streaks is 0, and chipping of the cleaning blade is observed.

G3: The number of the colored streaks is 1 to 3, and chipping of the cleaning blade is observed.

G4: The number of the colored streaks is 4 to 6, and chipping of the cleaning blade is observed.

G5: The number of the colored streaks is 7 or more, and chipping of the cleaning blade is observed.

TABLE 1

| | | Layered compound particles | | | Titanium oxide particles | | | | | | |
|---|---|---|---|---|---|---|---|---|---|---|---|
| | Toner particles | Type | Volume average particle size [μm] | Content in entire toner Ma [%] | Mode of addition | Number average primary particle size [nm] | Content in entire toner Mb [%] | Ti content [ppm] | Mb/Ma | Filming on surface of photosensitive member | Wearing of cleaning blade |
| Comparative example 1 | (1) | MC(1) | 2.8 | 0.1 | — | — | 0 | 0 | 0 | G5 | G3 |
| Comparative example 2 | (1) | MC(1) | 2.8 | 0.1 | External | 15 | 0.16 | 1500 | 1.6 | G3 | G5 |
| Example 1 | (1) | MC(1) | 2.8 | 0.1 | External | 15 | 0.05 | 500 | 0.5 | G1 | G1 |
| Example 2 | (1) | MC(1) | 2.8 | 0.1 | External | 15 | 0.00002 | 0.2 | 0.0002 | G3 | G1 |
| Example 3 | (1) | MC(1) | 2.8 | 0.1 | External | 15 | 0.14 | 1400 | 1.4 | G1 | G3 |
| Example 4 | (1) | MC(1) | 2.8 | 0.02 | External | 15 | 0.02 | 200 | 1.0 | G2 | G2 |
| Example 5 | (1) | MC(1) | 2.8 | 0.9 | External | 15 | 0.05 | 500 | 0.06 | G2 | G2 |
| Example 6 | (1) | MC(1) | 2.8 | 0.1 | External | 30 | 0.05 | 500 | 0.5 | G2 | G1 |
| Example 7 | (1) | MC(2) | 0.4 | 0.1 | External | 15 | 0.05 | 500 | 0.5 | G2 | G3 |
| Example 8 | (1) | MC(3) | 8.0 | 0.1 | External | 15 | 0.05 | 500 | 0.5 | G3 | G2 |
| Example 9 | (1) | MC(4) | 1.0 | 0.1 | External | 15 | 0.05 | 500 | 0.5 | G1 | G2 |
| Example 10 | (1) | MC(5) | 6.9 | 0.1 | External | 15 | 0.05 | 500 | 0.5 | G2 | G1 |
| Example 11 | (1) | BN | 2.8 | 0.1 | External | 15 | 0.05 | 500 | 0.5 | G1 | G2 |
| Example 12 | (2) | MC(1) | 2.8 | 0.1 | Internal | — | 0.05 | 500 | — | G1 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising:
toner particles;
layered compound particles; and
inorganic particles,
wherein a content of titanium in the electrostatic image developing toner is 0.1 ppm or more and less than 1,500 ppm.

2. The electrostatic image developing toner according to claim 1,
wherein the content of titanium is 0.1 ppm or more and 500 ppm or less.

3. The electrostatic image developing toner according to claim 2,
wherein a content of the layered compound particles in the electrostatic image developing toner is 0.01% by mass or more and 1.0% by mass or less of a total amount of the electrostatic image developing toner.

4. The electrostatic image developing toner according to claim 3,
wherein the content of the layered compound particles is 0.02% by mass or more and 0.9% by mass or less of the total amount of the electrostatic image developing toner.

5. The electrostatic image developing toner according to claim 2,
wherein the layered compound particles have a volume average particle size of 0.4 μm or more and less than 8.0 μm.

6. The electrostatic image developing toner according to claim 1,
wherein a content of the layered compound particles in the electrostatic image developing toner is 0.01% by mass or more and 1.0% by mass or less of a total amount of the electrostatic image developing toner.

7. The electrostatic image developing toner according to claim 6,
wherein the content of the layered compound particles is 0.02% by mass or more and 0.9% by mass or less of the total amount of the electrostatic image developing toner.

8. The electrostatic image developing toner according to claim 6,
wherein the layered compound particles have a volume average particle size of 0.4 μm or more and less than 8.0 μm.

9. The electrostatic image developing toner according to claim 1,
wherein the layered compound particles have a volume average particle size of 0.4 μm or more and less than 8.0 μm.

10. The electrostatic image developing toner according to claim 9,
wherein the volume average particle size of the layered compound particles is 1.0 μm or more and 7.0 μm or less.

11. The electrostatic image developing toner according to claim 1,
wherein the inorganic particles include titanium oxide particles.

12. The electrostatic image developing toner according to claim 11,
wherein a mass ratio Mb/Ma of a content Mb of the titanium oxide particles in the electrostatic image developing toner to a content Ma of the layered compound particles in the electrostatic image developing toner is 0.0002 or more and 1.55 or less.

13. The electrostatic image developing toner according to claim 12,
wherein the mass ratio Mb/Ma is 0.05 or more and 1.0 or less.

14. The electrostatic image developing toner according to claim 1, wherein the inorganic particles include silica particles.

15. The electrostatic image developing toner according to claim 1, wherein the layered compound particles include at least one type of particles selected from the group consisting of melamine cyanurate particles, boron nitride particles, graphite fluoride particles, molybdenum disulfide particles, and mica particles.

16. An electrostatic image developer comprising the electrostatic image developing toner according to claim 1.

17. A process cartridge detachably attachable to an image forming apparatus, the process cartridge comprising:

an image holding member;

a developing unit that includes the electrostatic image developer according to claim 16 and develops an electrostatic image formed on a surface of the image holding member with the electrostatic image developer to form a toner image; and a cleaning unit that includes a blade arranged to contact with the surface of the image holding member and removes a toner that remains on the surface of the image holding member after transfer of the toner image with the blade.

18. An image forming apparatus comprising:

an image holding member;

a charging unit that charges a surface of the image holding member;

an electrostatic image formation unit that forms an electrostatic image on the charged surface of the image holding member;

a developing unit that includes the electrostatic image developer according to claim 16 and develops the electrostatic image formed on the surface of the image holding member with the electrostatic image developer to form a toner image;

a transfer unit that transfers the toner image formed on the surface of the image holding member onto a surface of a recording medium;

a fixing unit that fixes the toner image transferred on the surface of the recording medium; and a cleaning unit that includes a blade arranged to contact with the surface of the image holding member and removes a toner that remains on the surface of the image holding member after transfer of the toner image with the blade.

19. An image forming method comprising:

charging a surface of an image holding member;

forming an electrostatic image on the charged surface of the image holding member;

developing the electrostatic image formed on the surface of the image holding member with the electrostatic image developer according to claim 16 to form a toner image;

transferring the toner image formed on the surface of the image holding member onto a surface of a recording medium;

fixing the toner image transferred on the surface of the recording medium; and bringing a blade into contact with the surface of the image holding member after transfer of the toner image to remove a toner that remains on the surface of the image holding member.

20. A toner cartridge detachably attachable to an image forming apparatus, the toner cartridge comprising the electrostatic image developing toner according to claim 1.

* * * * *